United States Patent [19]

Reynolds

[11] Patent Number: 5,036,562

[45] Date of Patent: Aug. 6, 1991

[54] PLAQUE REMOVING DENTAL HYGIENE APPARATUS

[76] Inventor: Fred W. Reynolds, 8362 Walker, Apt. 20, La Palma, Calif. 90623

[21] Appl. No.: 597,007

[22] Filed: Oct. 15, 1990

[51] Int. Cl.[5] ..... A47B 9/04

[52] U.S. Cl. ..... 15/167.1; 15/105; 15/22.1

[58] Field of Search ..... 433/99, 72; 15/167.1, 15/105

[56] References Cited

U.S. PATENT DOCUMENTS

| | | | |
|---|---|---|---|
| 2,418,344 | 4/1947 | Goldberg | 15/167.1 |
| 2,601,567 | 6/1952 | Steinberg | 15/167.1 |
| 2,877,477 | 3/1959 | Levin | 15/105 |
| 3,978,852 | 9/1976 | Annoni | 15/167.1 |
| 4,283,808 | 8/1981 | Beebe | 15/167.1 |
| 4,476,604 | 10/1984 | White et al. | 15/167.1 |
| 4,680,825 | 7/1987 | White et al. | 15/167.1 |

*Primary Examiner*—Harvey C. Hornsby
*Assistant Examiner*—Patrick F. Brinson
*Attorney, Agent, or Firm*—Jack C. Munro

[57] ABSTRACT

A dental hygiene apparatus for removing plaque which is to connect with the handle of a conventional toothbrush with the toothbrush being used as the instrument to remove plaque. The handle is mounted through the open end of a cylindrical sleeve-like handle that is of a size to be readily graspable by a human being. A spring arrangement is located within the interior chamber and is to connect with the handle of the toothbrush to impart a biasing force against the handle of the toothbrush against the handle deflecting. The handle of the toothbrush is secured by a threaded bolt which is threadably engaged to the wall of the sleeve. The apparatus is to be manually used causing the bristles of the toothbrush to be moved in a direction toward the teeth of the user.

2 Claims, 1 Drawing Sheet

PLAQUE REMOVING DENTAL HYGIENE APPARATUS

BACKGROUND OF THE INVENTION

The field of this invention relates to dental hygiene devices and more particularly to an apparatus for removing plaque from the teeth and gingival areas of a human being.

The presence of periodontal diseases within human beings has indicated the need for devices to prevent the formation of bacterial plaque colonies in the periodontal areas. It is well established that plaque bacteria is the primary cause of periodontal disease.

The problems of effectively removing plaque from tooth surfaces is well recognized in the dental field. It is recognized that it is difficult to effectively remove plaque from the tooth surfaces adjacent the gum line and the gingival cuff around each tooth and from those surfaces of the teeth that face adjacent teeth. Conventional manual actuated toothbrushes do not properly clean these surfaces.

To get at the inaccessible surfaces and spaces between teeth, dentists usually recommend the use of dental floss. Dental floss, if used properly, is effective to remove both food particles from embrasures existing between adjacent teeth and it is also effective to remove plaque from convex surfaces where the dental floss can be engaged. However, dental floss does not reach into any concave surface or crevice and therefore cannot remove plaque from such surfaces. It is also difficult with dental floss to remove plaque from tongue side surfaces of the teeth and cheek side tooth surfaces near the gum line. Dental floss also suffers a disadvantage in that the user often does not make the most effective use of it. As a practical matter, dental floss cannot be used to clean the spaces between the spaces of orthodontic appliances and teeth or to clean embrasure areas such as those existing between the roots of a tooth and a gum line which has been lowered by periodontal surgery or those embrasure areas existing between a crown or bridgework and an associated tooth or gum surface.

In the past, a number of power driven toothbrushes have been designed and constructed to facilitate cleaning of the teeth. These power driven toothbrushes are normally directed to the concept of reciprocating the toothbrush in a direction either along the length or across the width of the brush head in a wiping type of action. This type of action of the toothbrush is not effective in cleaning embrasures related to surfaces such as deep crevices in molars, tooth surfaces at the gum line, the gingival cuff area and the tooth surfaces of embrasures such as exist in the spaces between adjacent teeth above the gum line.

It is known that in order to effectively remove plaque from teeth, the movement of the toothbrush is not to be in a wiping action but is to be in a probing direction directly toward the teeth. In other words, pushing the toothbrush repeatedly in a direction directly into the teeth and into the gum area of the teeth. This type of movement for a toothbrush is shown and described within U.S. Pat. No. 3,978,852 issued Sept. 7, 1976, inventor Jerry D. Annoni. This Annoni toothbrush is power driven and is designed to reciprocate the bristle head of the brush pushing such in a direction toward the teeth. For some reason unknown to the present inventor, the structure of the Annoni patent is not on the market at the present time. Possibly, one reason it is not available is that the device of Annoni is reasonably complex in construction which would probably result in a high selling price to the consumer.

In the past, it has been proposed to use sonic type of devices to remove plaque on teeth. Reference is to be had to U.S. Pat. No. 4,787,847, issued Nov. 29, 1988 to Roy W. Martin, et al. which discloses such a sonic device. It is anticipated that probably the complexity of construction and the ultimate selling costs of the structure of this patent has prevented this product from being available in the open market.

Up until the present invention, the primary technique that facilitated removal of plaque within the home was by the use of dental floss. The most common way of using dental floss is for the individual to cut off a length of floss from a dental floss dispenser and introduce the length of floss into the mouth with the individual holding the strand of floss taut. Flossing in this manner requires considerable coordination and perseverance. The procedure is not only time consuming, since a complete set of teeth is twenty-eight areas between teeth. Also, putting of one's fingers in one's mouth is not the most desirable of experiences. Not only is it normally inherently distasteful to locate one's fingers in one's mouth, some people are employed in jobs which cause their hands to become deeply stained with contaminates or odorants which makes this physically distasteful for them to place their fingers within their mouths. For example, the hands of an automobile service station worker may become deeply grimed with carbon and the strong odor of gasoline. Still further, the physical working area within one's mouth is confined. The physical size of one's fingers are normally too large to facilitate usage of dental floss within one's mouth.

SUMMARY OF THE INVENTION

The primary objective of the present invention is to construct a tool which is to be utilized with a conventional toothbrush to arrive at an effective dental flossing (plaque removing) tool.

Another objective of the present invention is to provide a tool which is simple in construction and can be manufactured and sold to the ultimate consumer at a relatively inexpensive price.

Another objective of the present invention is to provide a tool which works better and is easier to use than the conventional dental flossing technique.

The plaque removing tool of the present invention is constructed in the form of a hollow sleeve which has an internal chamber which is open at each end. Mounted within the side wall of the sleeve is a threaded member resembling a bolt. The handle of a conventional toothbrush is to be inserted within the internal chamber with the bristle head of the toothbrush being located a short spaced distance from the sleeve. Tightening of the bolt exerts a binding action on the handle of the toothbrush thereby fixing in position the toothbrush to the sleeve. The sleeve is to be grasped and the bristle head of the toothbrush to be inserted in one's mouth with repeated manual movements being applied tending to move the bristle head of the toothbrush into the teeth. The toothbrush is to resiliently deflect, not only inherently because of the toothbrush handle itself, but also because there is a spring arrangement mounted within the internal chamber that exerts a bias against the handle of the toothbrush as the handle is moved.

DETAILED DESCRIPTION OF THE SHOWN EMBODIMENT

Figure 1:
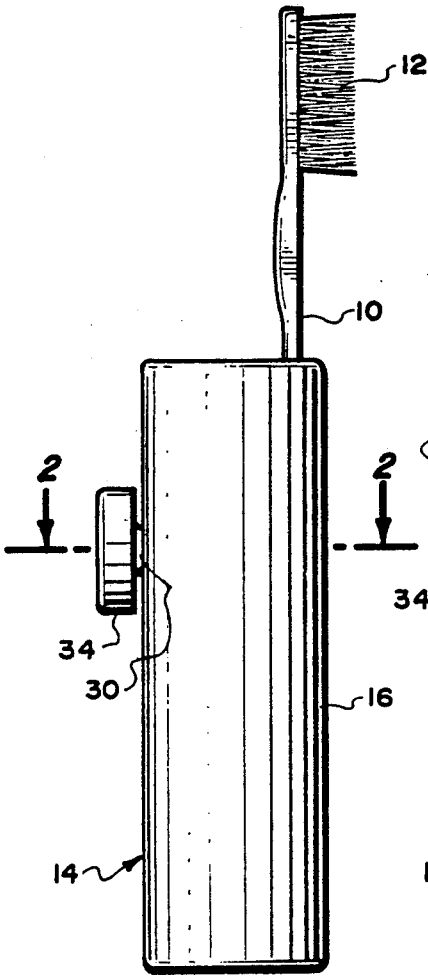
FIG. 1 is a side elevational view of the dental hygiene apparatus of the present invention showing a conventional toothbrush mounted in conjunction with the apparatus.

Referring particularly to the drawing, there is shown a conventional toothbrush handle 10 to which is fixedly mounted at one end thereof a bristle head 12. The apparatus 14 of this invention is composed of a cylindrical wall housing 16 which is formed of any rigid material such as plastic. The wall housing 16 has an internal chamber 18. Internal chamber 18 has an open end 20 at one end thereof and at the opposite end thereof has an open end 22.

Fixedly mounted to the interior wall of the internal chamber 18 directly adjacent the open end 22 is a coil spring 24. In a similar manner, an identically sized coil spring 26 is mounted to the wall of the interior chamber 18 but located directly adjacent the open end 20. The coil springs 24 and 26 are of a preselected length so that the outer end of these springs is spaced a short distance from the wall of the internal chamber 18. This permits the handle 10 of the toothbrush to be inserted and slide past the springs 24 and 26 as is readily shown in FIG. 3 of the drawing.

Formed through the wall 16 is a threaded hole 28. Threadably secured within the threaded hole 28 is a threaded member 30 resembling the body portion of a conventional bolt. THe other end of the threaded member 30 is fixedly connected to an enlarged head 32. Mounted about the enlarged 32 is a protective cover 34 with this cover 34 to facilitate manual grasping and turning of the bolt 30. It is to be noted that the longitudinal axis of the bolt 30 is substantially parallel to the longitudinal axis of both of the coil springs 24 and 26. It is also to be noted that the threaded opening 28 is located nearer the open end 20 than the open end 22.

Figure 3:
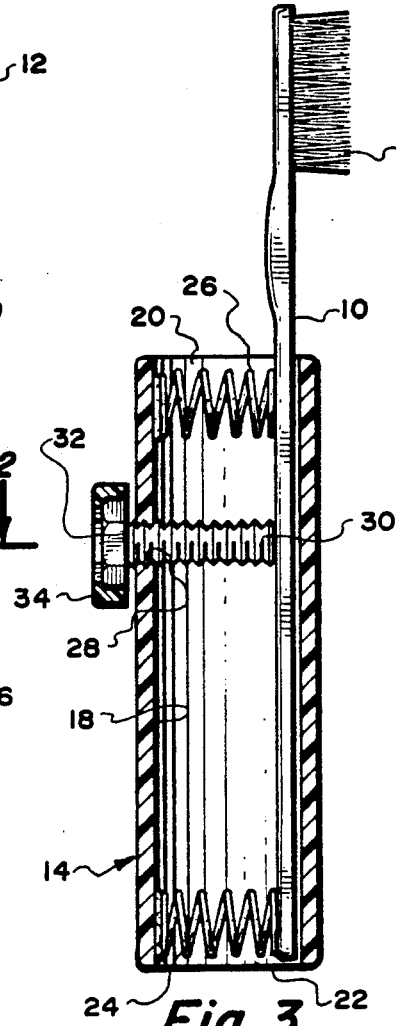
FIG. 3 is a longitudinal cross-sectional view through the dental hygiene apparatus of the present invention taken along line 3—3 of FIG. 2 with the toothbrush handle being mounted within one end of the apparatus.
Figure 5:
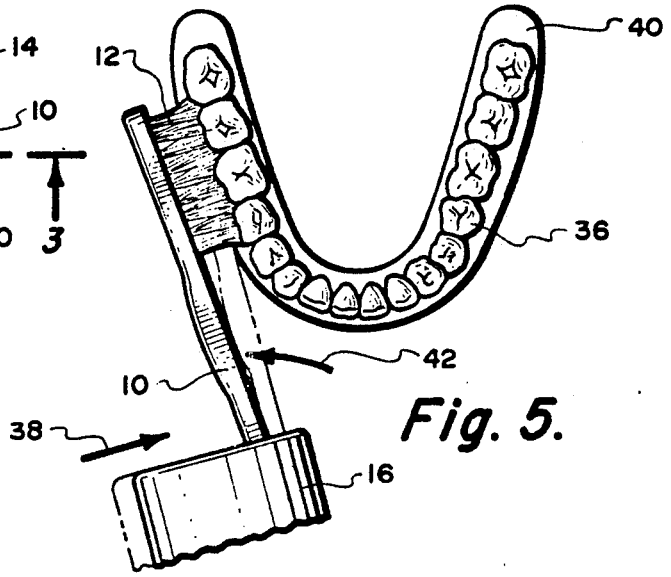
FIG. 5 is a diagrammatic view depicting usage of the dental hygiene apparatus of the present invention on teeth.

If the handle 10 of the toothbrush is readily bendable, the handle 10 is to be mounted in conjunction with the apparatus 14 as clearly shown within FIGS. 1 and 3 of the drawing. In this portion, the bristle head 12 is located directly adjacent the open end 20 with the lower end of the handle 10 being located directly adjacent the spring 24. When the handle 10 is in the proper position, the bolt 30 is to be securely tightened binding the handle 10 against the wall of the internal chamber 18. When the apparatus 14 is used, as is depicted in FIG. 5, the operator exerts a pushing force on the sleeve 16 in a direction represented by arrow 38. This causes the bristles 12 to be moved inwardly into the crevices between the teeth 36 as is shown in FIG. 5. It is important to prevent injury to the gum 40 that support the teeth 36 that the handle 10 deflect against the action of this pushing force represented by arrow 38. This deflection is represented by arrow 42. It is to be understood that the apparatus 14 is used, as shown in FIGS. 1 and 3, only when the handle 10 is rather bendable.

Figure 4:
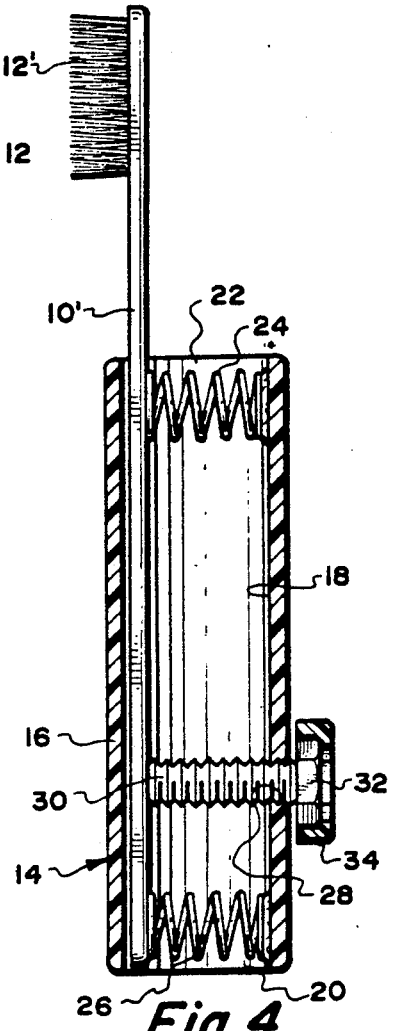
FIG. 4 is a view similar to FIG. 3 but showing the toothbrush handle mounted within the opposite end of the apparatus.
Figure 2:
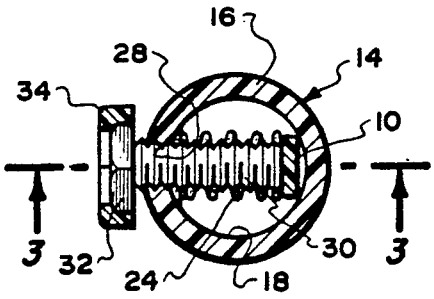
FIG. 2 is a transverse cross-sectional view taken along line 2—2 of FIG. 1.

If the handle of the toothbrush is rather rigid (not bendable), with such a handle 10' being shown in FIG. 4, then when the bristles 12' are moved in conjunction with the teeth 36 it is desirable to have the handle 10' be mounted in conjunction with the apparatus as shown in FIG. 4. In this position, it can be seen that the handle 10' is conducted through the open end 22 with the threaded member 30 located much further away from the bristle head 12' than what is shown in FIGS. 1 and 3. This increases the overall ability of the handle 10' to deflect which is represented by the arrow 42.

It is important to note that it is desirable to have a certain amount of deflection, but not have that deflection to be too easy. Once the user grasps the exterior surface of the sleeve 16 and manually maneuvers the bristle head 12 or 12', the user can quickly ascertain as to whether the toothbrush handle 10 is to be in the position shown in FIG. 3 or handle 10' is to be in the position as shown in FIG. 4. In other words, the particular way that the apparatus 14 is utilized is strictly a judgment call for the particular user.

The user is not only able to maneuver the bristle head 12 or 12' into the exterior surface of the teeth (cheek side) but also able to position and maneuver the brush head 12 and 12' against the inside surfaces of the teeth (tongue side) which is not shown.

What is claimed is:

1. A dental hygiene apparatus for removing plaque comprising:

a toothbrush, said toothbrush having a handle which terminates in a bristle head, bristles mounted on said bristle head;

a graspable sleeve, said sleeve having a first end and a second end, said sleeve having an interior chamber, a first access opening formed in said first end, said first access opening connecting with said interior chamber;

securing means mounted on said sleeve, said securing means extending across said interior chamber, said securing means being movable between a securing position holding said handle within said chamber for pivotal movement about said securing means and an unsecured position permitting movement of said handle in said chamber, said securing means being positioned nearer said first end than said second end;

said handle to be located in said internal chamber, said securing means fixing the position of said handle when in said securing position, whereby said bristles are readily manually pressable in the direction toward the teeth of the user with resilient deflection of said handle occurring thereby facilitating removing of the plaque by said bristles; and spring means mounted within said interior chamber, said spring means to engage with said handle to impart a resilient force against said handle as said handle is deflected about said securing means, said spring means being located between said securing means and said bristles, said chamber having a second access opening formed in a second end opposite said first end, said handle to be extendable within either said first access opening or said second access opening into said interior chamber, during usage of said apparatus the resilient force of deflection varying from when said handle is located within said first access opening as compared to when said handle extends through said second access opening.

2. The dental hygiene apparatus as defined in claim 1 wherein:

said securing means comprising a screw threaded member, said screw threaded member having a manually operable knob to facilitate manual movement of said screw threaded member from said securing position to said unsecured position.

* * * * *